US005700159A

United States Patent [19]

Albeck

[11] Patent Number: 5,700,159

[45] Date of Patent: Dec. 23, 1997

[54] ELECTRICAL CONNECTION ELEMENT

[75] Inventor: Bernhard Albeck, Lorch-Waldhausen, Germany

[73] Assignee: Vossloh-Schwabe GmbH, Urbach, Germany

[21] Appl. No.: 624,800

[22] Filed: Mar. 27, 1996

[30] Foreign Application Priority Data

Mar. 30, 1995 [DE] Germany ..... 195 11 655.0

[51] Int. Cl.[6] ..... H01R 13/74

[52] U.S. Cl. ..... 439/571; 439/95; 439/567

[58] Field of Search ..... 439/92, 95, 94, 439/567, 571, 572, 717

[56] References Cited

U.S. PATENT DOCUMENTS

| | | | |
|---|---|---|---|
| 5,442,848 | 8/1995 | Koller et al. | 29/566.1 |
| 5,480,323 | 1/1996 | Mews et al. | 439/395 |

FOREIGN PATENT DOCUMENTS

| | | |
|---|---|---|
| 0 327 703 | 8/1989 | European Pat. Off. . |
| 1 238 086 | 4/1967 | Germany . |
| 1515 659 | 11/1969 | Germany . |
| 98 422 | 6/1973 | Germany . |
| 29 31 441 | 2/1980 | Germany . |
| 89 02 163 U | 6/1989 | Germany . |
| 38 13 895 | 7/1989 | Germany . |
| 91 11 298 U | 2/1992 | Germany . |
| 43 12 781 | 10/1994 | Germany . |

*Primary Examiner*—Gary F. Paumen
*Attorney, Agent, or Firm*—Frishauf, Holtz, Goodman, Langer & Chick, P.C.

[57] ABSTRACT

To permit easy connection, and further to provide an electrical connection between a conductor and an electrically conductive device, for example, a base plate of a large fixture, a housing (4) of insulating material which has a contact element therein, and a flat surface (9) adapted to be placed against the device (7), is further formed with a metallic strip (28) electrically connected to the contact element (5). The metallic strip is formed with a bend or crease line (34) separating the strip into a neck portion (31) and a hook portion (36). The neck portion and the hook portion, together with the insulated housing (4), form a lever (48) in which the hook portion, upon insertion thereof through an aperture (45) in the flat surface of the device passes beneath and becomes located under the flat surface, engaging thereagainst and being supported therefrom, to permit at least part of the neck portion (31) to be passed, by lever action, through the aperture (45).

20 Claims, 6 Drawing Sheets

ELECTRICAL CONNECTION ELEMENT

Reference to related applications and patents, assigned to the assignee of the present application, the disclosures of which are hereby incorporated by reference:

U.S. Pat. No. 5,442,848, Koller et al

U.S. Pat. No. 5,480,323, Mews et al

U.S. application Ser. No. 08/190,131, filed Feb. 3, 1994, Albeck et al U.S. Pat. No. 5,515,606, May 14, 1996;

U.S. application Ser. No. 08/227,613, filed April 14, 1994, Hammer et al Continuation application Ser. No. 08/658,632, Jun. 5, 1996: U.S. Pat. No. 5,575,679, Nov. 19, 1996;

U.S. application Ser. No. 08/561,159, filed Nov. 21, 1995, Albeck et al;

U.S. application Ser. No. 08/230,063, filed Apr. 20, 1994, Mews et al continuation application Ser. No. 08/701,198, Aug. 21, 1996.

FIELD OF THE INVENTION

The present invention relates to a connection element to connect electrical conductors to electrical devices, and more particularly to such a connection element which, in addition to providing connection terminals within an insulated housing for connecting wires, also provides for forming an electrical connection with the device, for example a metallic plate of a light fixture, and thus provide a terminal for a grounding or neutral connecting line which is connected to the metal of the fixture.

BACKGROUND

Upon wiring of stationary or mobile electrical apparatus, for example luminaires, light fixtures or the like, it is frequently necessary to provide for connection to a safety circuit, for example a grounding wire. Electrically conductive portions of the housing or individual structural groups of circuit connections which are electrically coupled to the housing may require such a protective circuit connection. Usually, apparatus or devices of this type have a connection terminal located within the interior of the housing and coupled thereto. The terminal also provides for electrical connection of circuits and units within the housing with other electrical lines, for example a neutral line, a grounding line or a phase line.

One such connection element is known from German Patent Disclosure DE 38 13 895 A1 of Köllmann. The connection element has a housing with contacts located in its interior, electrically insulated from one another. One of the contacts is intended for connection of the protective conductor and is joined to a plug contact that protrudes from the housing. While the housing has a flat bottom intended for placement on a flat underlying surface on which interengaging detent stubs are formed, the plug-in contact protrudes laterally out of the housing. The plug-in contact is first bent twice, so that it has one portion, located in the plane of the housing bottom, that is bent once again at its free end such that it protrudes past the bottom of the housing, aligned approximately parallel with the detent stubs. The plug-in contact has a slit that divides the contact into two legs parallel to one another, with teeth on their outsides.

The spacing of the legs from one another, measured from the respective outer edges, is markedly greater than the diameter of a hole provided in the applicable part to be connected. This makes the legs difficult to insert into the hole, and a relatively major insertion force is required. The user who is seeking to make the electrical connection must exert this force by exerting pressure on the housing.

From U.S. Pat. No. 4,895,526, to which European Patent Disclosure EP 0 327 703 B1, to Henrici et al, corresponds a connection element or connecting clamp for electrical equipment is known that likewise has a plug-in contact for electrically connecting metal supporting parts or housing parts. The connection element has a housing with a receiving chamber in which there is a springy clamping terminal for connecting a protective conductor. The springy clamping terminal is connected to a plug, embodied as a strip, that protrudes from the flat side of the housing. The plug extends, without bending, in a straight line away from the housing. Two tongues extending toward the housing are cut apart from the plug and bent away from it in alternating directions, forming an acute angle with it. The plug is intended to be plugged into a rectangular aperture of a metal sheet or plate acting as a support surface, which by this means is intended to be connected to the protective conductor. The rectangular aperture is adapted to the dimensions of the plug in such a way that the plug is wedged into the aperture. The resilient tongues prevent it from slipping out of the aperture. If an undersized plug is inserted into the aperture, then all the force required for its insertion must be brought to bear by exerting pressure on the housing.

From U.S. Pat. No. 5,480,323, Mews et al, a connection element for connecting an electrical device is known that likewise has a plug-in contact as a grounding strip for connection for a protective conductor. The connection element has a housing which receives a slit-blade insulation-piercing (SBIP) connector bent from sheet metal. The housing is disposed on a base and is joined to it. The base is meant to be connected electrically conductively to a protective conductor. To that end, an SBIP connector is provided whose bottom portion also has a springy clamping terminal formed by two opposed tongues. An opening on the bottom of the housing, through which the insertion lug of a grounding strap passes, is located opposite the springy clamping terminal. The insertion lug is placed between the resilient tongues or tabs provided on the SBIP connector and is both retained and electrically connected by them. The insertion lug is adjoined by a widened portion with two locking tabs cut away from it, which are bent slightly out of the plane of the grounding strap. They serve to lock the grounding strap in a slitlike opening of a base part, such as a housing bottom that is to be connected.

In this connection element as well, the force necessary to push the grounding strap into the slitlike opening must be brought to bear by pressure on the housing. Moreover, the grounding strap protrudes past the housing bottom, so that if there is not enough space underneath the housing bottom, for instance, it is difficult to insert the grounding strap all the way into the opening.

THE INVENTION

It is an object of the invention to provide an electrical connection element which can be assembled to an electrical device, for example a luminaire, light fixture, portable lamp or other portable apparatus, and make reliable electrical contact therewith easily, without requiring substantial assembly force or tools or other accessory devices.

Briefly, the connection element has an insulating housing formed with an essentially flat engagement surface. The engagement surface is adapted to be placed against a support e.g. a support surface for the device, which is formed with at least one aperture. The housing carries an attachment means to attach the connection element to the support surface. At least one contact element is located within the housing for connection to an electrical line, for example a grounding conductor. In accordance with a feature of the invention, a metallic strip is secured in the housing, electrically connected to the contact element, and formed with a bend or crease line intermediate the length thereof, separating the strip into a neck portion and an angled-over hook portion. The neck portion and the hook portion, together with the insulated housing, form a lever in which the hook portion, upon being passed through the aperture in the support surface, passes beneath and can engage from below against the support surface, to be supported thereby, and make electrical contact therewith and permit the neck portion to be passed, by lever action, through the aperture. The hook portion will lie against the support surface, essentially flat, or at the most slightly bowed, securely anchoring the housing in position against the support surface.

The connection or contact element will not have projecting parts, when placed on a support surface. The metallic strip, in the shape of a bracket, passes through the opening in the support surface and rests essentially flat against the back side thereof, and thus no part protrudes away from the support surface. This makes the connection element especially well-suited for connecting a connector having a grounding terminal to a housing or housing part of some electrical device, such as a light fixture or the like. The connection element can then be located in an enclosed interior of the device, for instance on a back wall of the device. Because the strip rests essentially flat on the applicable part of the housing, the risk of injury from connection terminals that have parts protruding away from the housing wall is markedly less.

The hook portion of the strip, which in the mounted state rests essentially flat on the applicable support portion, additionally secures the connection element on the support. The hook of the strip engages the support portion from behind and thus retains the connection element on the support surface. This is true even if the electrical device is installed, for instance being mounted on the support. The connection element can be mounted on a housing base resting flat on the support or base plate to which the device is attached. There is no danger that the strip will be pressed out of the aperture in which it is seated, and in which it engages the support from behind by its hook portion. Nor is there any danger that the strip might be significantly deformed, or that electrical contact between the strip and the support plate would be impaired in any way. This security against the strip being forced out of the aperture is attained without using additional securing means thereof. The strip is self-securing on the support; moreover, it does not present any point of engagement where damage could occur.

The strip may be formed such that its neck portion is closed, slit, or provided with prongs. It can also be either flat or curved. What is essential is that it have cutting edges that cut into the edge of the aperture into which it is to be inserted. Bending or curving of the neck portion with a radius that is within the plane of the engagement surface increases the rigidity of the strip against later bending and makes possible a certain elasticity with respect to the aperture.

Exemplary embodiments of the invention are shown in the drawings and will be described in detail below.

DRAWINGS

DETAILED DESCRIPTION

Figure 1:
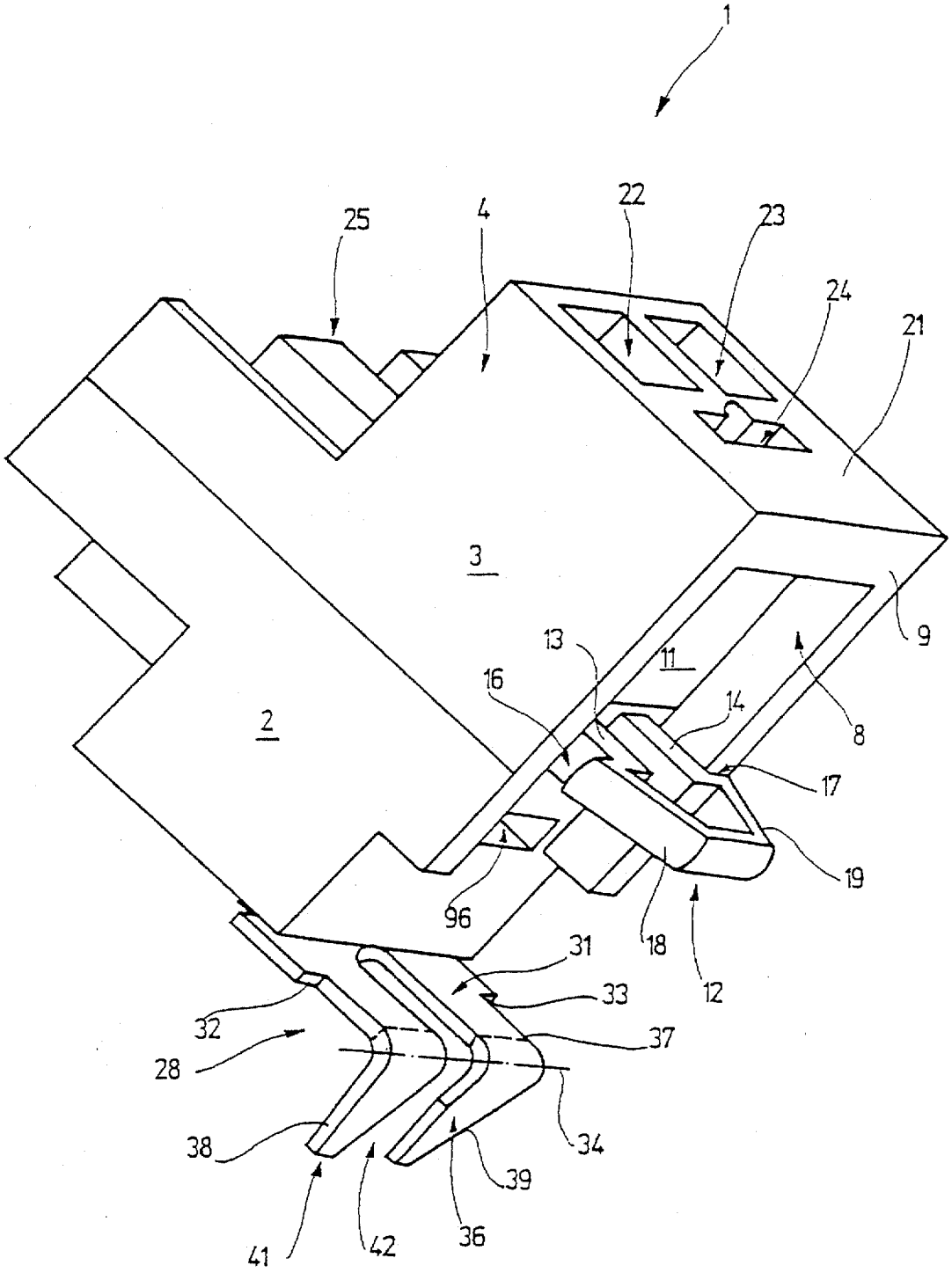
FIG. 1 is a perspective view of a basic illustration of the connection element.

A connection element 1 shown in FIG. 1 has a housing 4 of insulating material, subdivided into two parts 2, 3, which in its interior accommodates a contact 5 to be described hereinafter (in conjunction with FIG. 5). The insulated housing 4 is intended for mounting on a support surface 7, for instance as shown in FIG. 2. The housing has an approximately cube-like basic shape, and a U-shaped edge 8 facing toward the support surface 7 defining a flat engagement surface 9. This surface is essentially parallel to a housing bottom 11, recessed from surface 9.

As an attachment means for retaining the insulated housing 4 on the support surface 7, a detent projection 12 is provided; it extends away from the housing bottom 11 and is integral with the part 2 of the insulated housing 4. The detent projection 12 has two legs 13, 14, extending parallel to and spaced apart from one another at right angles away from the housing bottom 11; these legs each define one outward-protruding shoulder 16, 17, at a slight distance from a plane defined by the engagement surface 9. From these shoulders, guide legs 18, 19 incline toward one another at an acute angle and are joined at their ends via a crosspiece. The detent projection is elastically resilient. The legs 13, 14 are capable of resilient motion toward one another.

The parts 2, 3 of the insulated housing 4 also have connection apertures, through which electrical lines not shown, can be connected to the contact 5 located in the interior of the insulated housing 4. As can be seen from FIG. 1, the part 3 is provided on its face end 21 with two spaced-apart, side-by-side line insertion apertures 22, 23, with which springy clamping terminals to be described hereinafter are associated in conjunction with the contact 5. This is also true for another aperture 24, provided on the face end 21, which is located just above the housing bottom 11, below the aforementioned line insertion apertures 22, 23. In addition, the two parts 2, 3 of the insulated housing 4 define a slit 25, in which a slit-blade insulation-piercing (SBIP) connector is retained, insulated from the outside.

Figure 4:
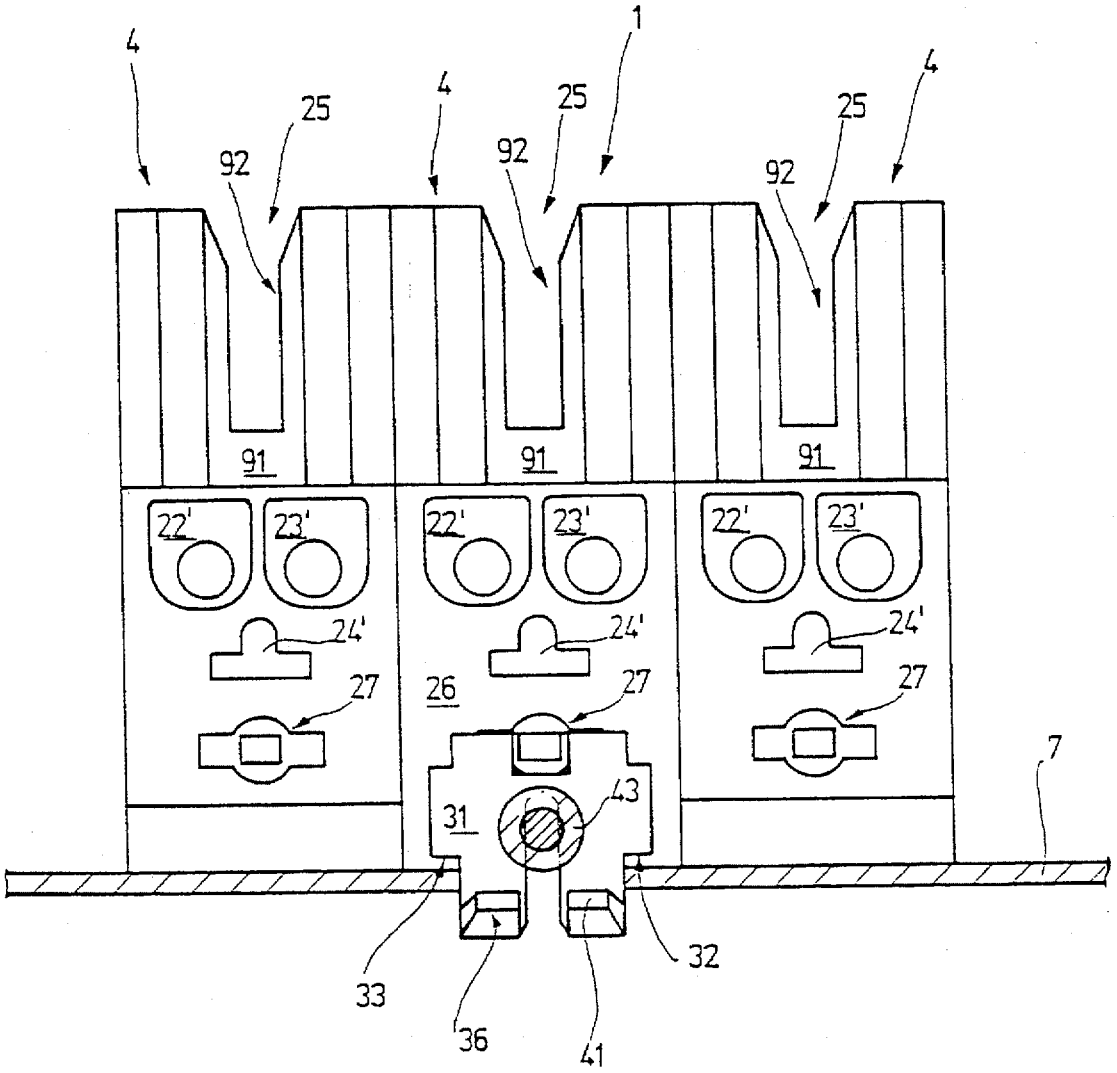
FIG. 4 is a front view, partly in section, showing the connection element of FIGS. 1–3 with one additionally connected line and in conjunction with other connection elements.
Figure 5:
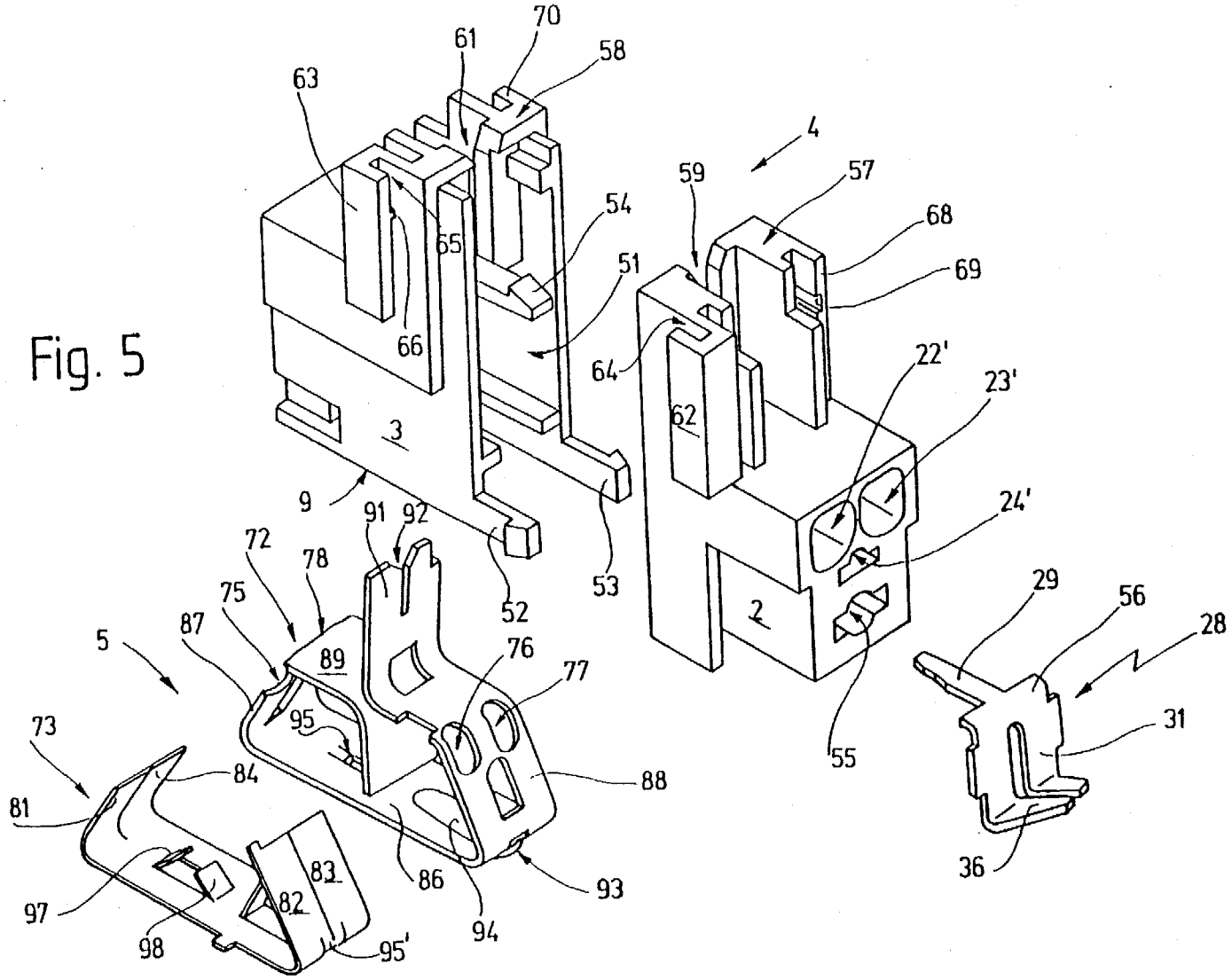
FIG. 5 is an exploded detail view of the connection element of FIG. 1.

On its face end 26 opposite and parallel to the face end 21, the part 2 of the insulated housing 4 has an insertion aperture 27, visible for instance in FIG. 4, in which a strip 28 acting as a grounding strip is inserted by an insertion tab 29, visible for instance in FIG. 5. The strip 28 is firmly held on the insulated housing 4 and is resistant to deflection.

Figure 2:
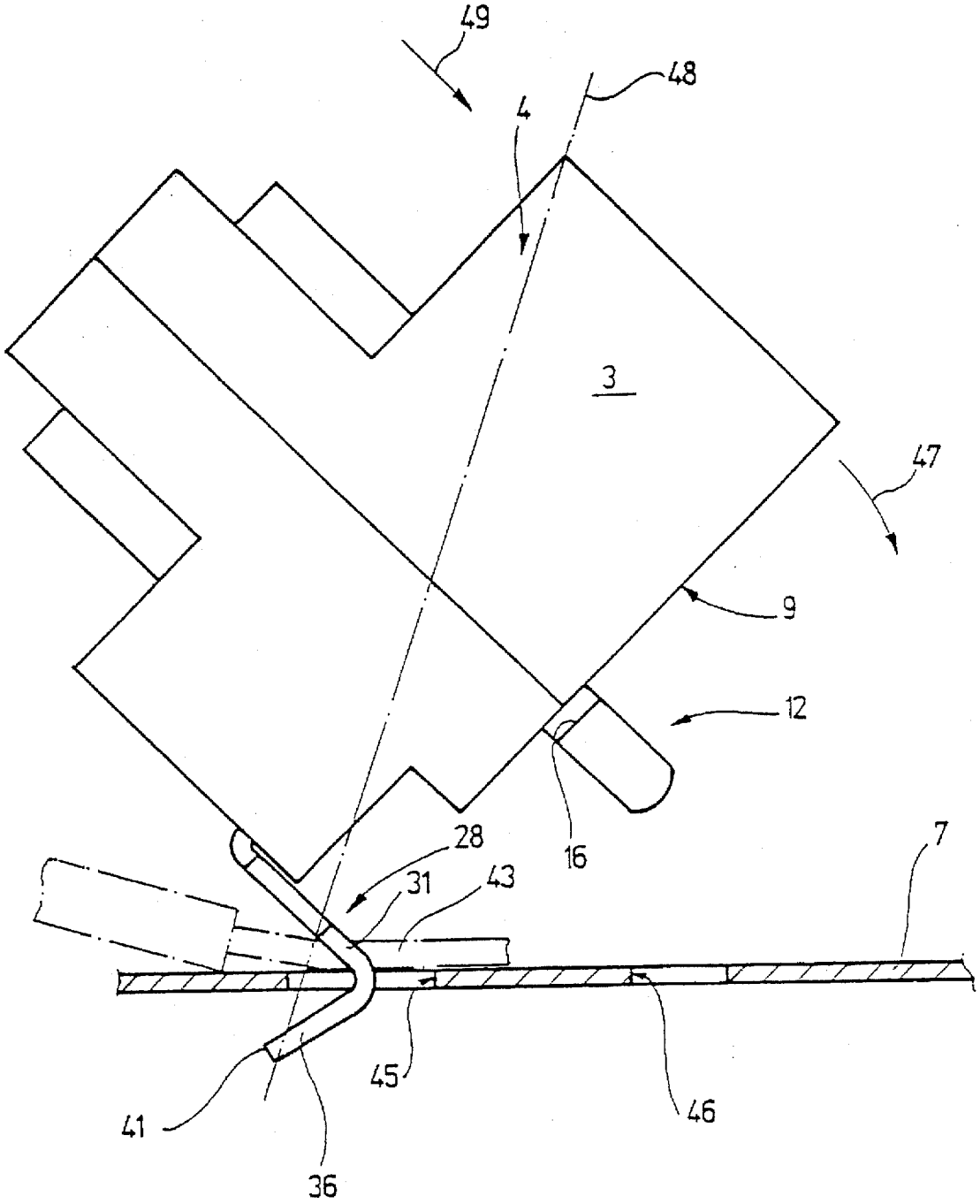
FIG. 2 is a side view, partly in section, of the connection element with the strip hooked into an aperture of the support surface.

In accordance with a feature of the invention, the strip 28 is a stamped-out shaped sheet-metal part, which adjacent to the insertion tab 29, as can be seen from FIG. 1, has a contact or neck portion 31 that extends essentially perpendicular to the housing bottom 11 and to the plane defined by the engagement surface 9. The neck portion 31 is a substantially flat or in other words plate-like region of the strip 28, with a relatively wide width that is slightly smaller than the width of the insulated housing 4. Approximately at the level of the plane defined by the engagement surface 9, the width of the neck portion 31 increases in stepwise fashion, forming engagement shoulders 32, 33 on both sides.

The neck portion 31 formed with parallel sides beginning at the engagement shoulders 32, 33 changes over at a bend or crease line 34 into a hook portion 36, which forms an acute angle of between 60° and barely 90° with the neck portion. In this specific instance, the angle is 75°. The neck portion 31, which in the present case is flat or in other words planar, may instead have a cross section of curved groove-like form or in an S shape. This allows resilience in the lateral direction while at the same time increasing the resistance to deflection.

Beginning at a transition point 37, suggested by a dashed line in FIG. 1, at which the neck portion 31 changes over to a bend, the strip 28 tapers. This means that it no longer has parallel sides but rather sides 38, 39 that extend toward one another at an acute angle.

The neck portion 31 is dimensioned in length such that the bend line 34 is located on the far side, in terms of the insulated housing 4, of the plane defined by the engagement surface 9. This means that the neck portion 31 protrudes past the engagement surface 9, while the hook portion 36, beginning at the bend line 34 which is spaced apart from the plane of the engagement surface 9, tapers toward the plane at an acute angle, but its free end 41 does not reach the plane itself. The distance between the free end 41 of the hook portion and the plane defined by the engagement surface 9 is approximately equal to the wall thickness of the support surface 7 that can be seen in FIG. 2.

For the strip 28, the length of the hook portion 38 is approximately equal to the width of the neck portion 31. The lower limit for the length of the hook portion 36 is half the width of the neck portion 31.

A slit 42 open at the edge extends from the free end 41 of the strip 28 to significantly beyond the engagement shoulders 32, 33, thus extending through both the hook portion 36 pointing away from the insulated housing 4 and the neck portion 31 that is essentially perpendicular to the housing bottom 11. The slit 42 ends essentially at the level of the housing bottom 11; the distance between the housing bottom 11 and the engagement shoulders 32, 33 is greater than the width of the slit 42. The length of the slit, measured from the engagement shoulders 32, 33 toward the housing bottom 11, is also greater than the width of the slit 42. While in the region of the neck portion 31 and particularly in the portion of the strip 28 located between the engagement shoulders 32, 33 and the housing bottom 11, the slit has an essentially constant width and thus is defined by parallel sides, its width in the region of the hook portion 36 is greater. In this region, the slit 42 widens toward its end 41, and the sides of the slit 42 in this region are at an acute angle to one another.

As shown particularly in FIG. 4, the slit 42 is an insulation-piercing slit for connection as needed of a line 43, which is suggested in dot-dashed lines in FIG. 2. The line 43 may terminate at the strip 28 as shown or may extend onward. Two or more lines can also be introduced into the slit 42 and thus connected to the strip 28.

The connection element 1 described thus far is secured to the support surface 7 as follows:

First, the support surface 7 is provided with two spaced-apart apertures 45, 46, whose center spacing matches the center spacing between the neck portion 31 of the strip 28 and the detent projection 12. The apertures 45, 46 are each round; the diameter of the aperture 45 is somewhat smaller than the diameter of the neck portion 36. The diameter of the aperture 46 also provided in the thin-walled plate-like portion of the support surface 7 is less than the distance between the farthest-outward-protruding portions of the shoulders 16, 17, so that the detent projection 12 can be inserted into the aperture 46 only if the legs 13, 14 bend elastically.

To attach the connection element 1 to the support surface 7 and thus connect the metallic support surface 7 to the contact 5 provided in the insulated housing 4, the strip 28 protruding from the insulated housing 4 is introduced by its hook portion 36 into the aperture 45. The hook portion 36 has a width that decreases toward its end 41 and that is smaller over the entire hook portion 36 than the diameter of the aperture 45. This makes it easy to introduce the hook portion 36 into the aperture 45. As shown in FIG. 2, the hook portion 36 engages the support surface 7 from behind. The width of the neck portion 31 is larger, at the latest beginning at the transition point 37, than the diameter of the aperture 45, so that the strip 28 is seated with its neck portion 31 above the support surface 7.

Figure 3:
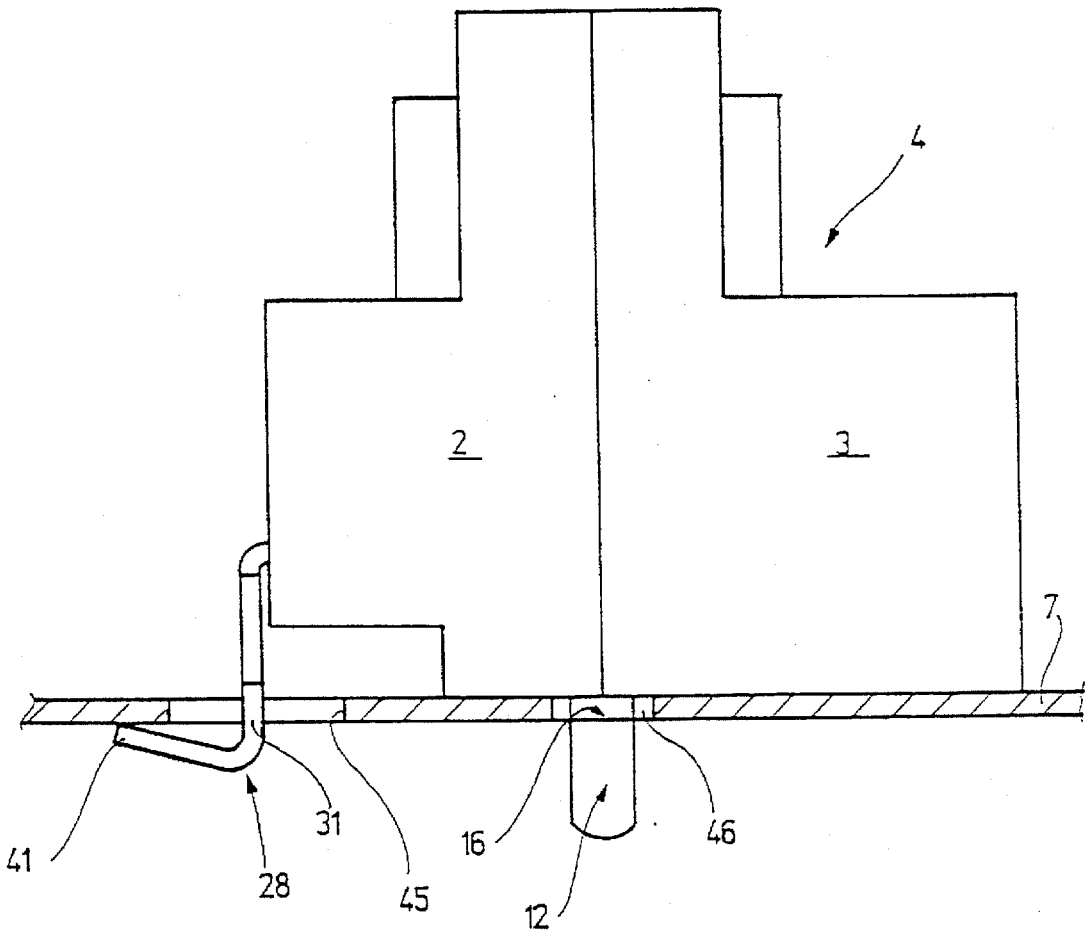
FIG. 3 is a side view, partly in section, of the connection element of FIGS. 1 and 2, in its final mounted state on the support surface.

By a swiveling motion of the connection element 1, which is suggested by an arrow 47 in FIG. 2, the insulated housing 4 and the strip 28 are changed to the position shown in FIG. 3. The hook portion 36 of the strip 28 first presses against the support surface 7 at the back. From that moment on, if not earlier, the strip 28, which is resistant to deflection, acts jointly with the insulated housing 4 as a lever, which is braced by its end 41 on the support surface 7.

The lever formed by the strip 28 and the insulated housing 4 is symbolically represented in FIG. 2 by a dot-dashed line 48. It can be seen that the distance between the end 41 and the neck portion 31 is substantially less than the distance from the end 41 to the end toward the housing of the lever represented by the dot-dashed line 48. This distance ratio means that a force, represented by the direction of an arrow 49, for instance, exerted on the part 3 of the insulated housing 4 is transmitted, considerably reinforced by lever action, to the neck portion 31. As a result, as soon as the end 41 of the strip 28 comes to rest on the support surface 7, the neck portion 31 is pressed into the aperture 45, by lever action and with destruction of any layers of paint present on the aperture 45; this requires only slight force, which can readily be exerted by hand, on the insulated housing 4.

The neck portion 31 is pressed into the narrower aperture 45, and in the process its sides deform the edge of the aperture 45. The strip 28, with its cutting edges present on its sides, cuts into the support material and an electrical contact is formed. The connection between the neck portion 31 and the support surface 7 at the aperture 45 also assures long-term reliable electrical contact-making. The connection is gas-tight, and so there is no need to fear corrosion that might impair the contact-making.

The strip 28 also, as can be seen from FIG. 3, rests with its end 41 on the back side of the support surface 7, without any parts of the strip 28 protruding away from the support surface 7. If the strip 28 is formed such that the spacing between its end 41 and the plane defined by the engagement face 9 is less than the wall thickness of the support surface 7, then the end 41 also rests with prestressing against the support surface 7, so that the contact point formed between the neck portion 31 and the support surface 7 is thereby additionally protected mechanically.

The detent projection 12 is seated in the aperture 46; the shoulders 16, 17 engage the support surface 7 from behind and secure the insulated housing 4 on it. In the position shown in FIG. 3, the connection element 1 is fully mounted on the support surface 7. Lines, such as for connecting the protective conductor, can now be connected to the contact 5 received by the insulated housing 4.

In the exemplary embodiment described above, only the support surface 7 has been connected via the strap 28 to the contact 5 received by the insulated housing 4. Via the line 43, additional component groups can be connected to a protective conductor connected to the contact. The connection of the line 43 is done as follows:

As seen from FIG. 2, the line 43 is placed, with or without insulation, on the support surface 7 at the aperture 45, and the insulated housing 4 is moved by hand toward the support surface 7 in such a way that the forked strip 28 receives the line 43 in its slit 42. The line 43 slides easily into the slit 43, which widens in funnel fashion toward the end 41. Because the slit 42 is narrower in the region of the neck portion 31 than the diameter of the line 43, the line clamps firmly in the slit, at the bend line 34 if not earlier. From there on, the line 43 cannot penetrate farther into the slit 42 without resistance.

By swiveling the connection element 1 toward the support surface 7 in the manner described, the neck portion 31 is now inserted into the aperture 45; the neck portion 31 and the line 43 together form an SBIP connector. The neck portion receives the line 43 in its slit, and in this region the line 43 is permanently deformed and with the strip 28 forms an SBIP connector. This connector, because it is also gas-tight, assures a durable and reliable electrical contact. The forces required to make the connection are slight, because of the lever action. The SBIP contact can thus be made by hand without any additional tool.

The insulated housing 4 acting as a lever and the strip 28 retained on it themselves act as a tool for generating the force required to make the insulating-piercing connection both between the strip 28 and the support surface 7 and between the strip 28 and the line 43 that may be connected as needed.

The insulated housing 4, shown merely schematically in FIGS. 1–3, is shown in detail in FIG. 5. The insulated housing is subdivided, along the plate at right angles to the engagement surface 9, into the parts 2, 3. For receiving the contact 5, the parts 2, 3 each have a recess, and the recesses define an interior chamber 51. For connecting the part 3 to the part 2, the part 3 has detent tongues 52, 53, 54, which engage corresponding recesses of the part 2. For connecting external lines to the contact 5, the part 2 has line introduction apertures 22', 23' and one further aperture 24', which correspond to the line introduction apertures 22, 23 and the aperture 24 of part 3 that can be seen in FIG. 1.

In addition, a connection aperture 55 is provided on the face end, and the insertion tab 29 of the strip 28 can be inserted through it into the interior chamber 51. The connection aperture 55 is rectangular in cross section and is considerably smaller in width than a flat insertion portion 56 that adjoins the insertion tab 29 and changes at a bend into the neck portion 31. On insertion of the insertion tab 29 into the connection aperture 55, the insertion portion 56 penetrates the part 2 of the insulated housing 4, deforming it in the region of the connection aperture 55. The insulated housing 4, that is, the parts 2, 3, are made of a plastically deformable plastic that firmly holds the pressed-in strip. This creates a mechanically stable connection between the strip 28 and the insulated housing 4, and this connection in particular easily absorbs the lever forces occurring on insertion of the strip 28 into the aperture 45 without coming loose.

On the side remote from the engagement face 9, the parts 2, 3 of the insulated housing each have a wall 57, 58, pointing away from the part 2, 3; each wall is provided with a respective slit 59, 61, and these slits jointly define the slit 25 for a line to be connected.

To enable coupling a plurality of similar insulated housings 4 to one another, as shown in FIG. 4, the wall 57 provided on the part 2 has an integrally formed-on portion 62 of U-shaped cross section, which protrudes beyond the part 2 in terms of its lateral boundary. A corresponding portion 63 is provided on the wall 58 of the part 3. The portions 62, 63 each have a respective groove 64, 65, and each groove is provided with a detent projection 66. The detent projection 66 protrudes from a side of each groove 64, 65 into that groove 64, 65.

On the opposite side, the wall 57 has a rib 68, which is dimensioned such that it fits into the groove 64 of a corresponding part 2. For receiving the detent projection 66, which is provided in the groove 64 but is not visible in FIG. 5, the rib 68 has a recess, on its inner side, with which the detent projection 66 interlocks.

A rib 70 is provided in a corresponding way laterally of the wall 58 of the part 3; this rib also has a recess, which is hidden in FIG. 5 and therefore not visible, for receiving the detent projection 66.

The portions 62, 63 and the ribs 68, 70 of the insulated housing 4 form connecting means, with which a strip connector can be constructed from a plurality of insulated housings 4. To that end, the insulated housings are first each put entirely together and then are thrust one inside the other in such a way that the portions 62, 63 of one insulated housing receive the ribs 68, 70 of an adjacent insulated housing. To that end, one insulated housing 4 is thrust from above with its portions 62, 63 onto the ribs 68, 70 of the adjacent insulated housing, until the detent projections 66 snap into the recesses 69.

The contact 5 located in the interior chamber 51 of the insulated housing 4 is a shaped sheet-metal part 72, in which a contact spring 73 is located. In association with the line introduction apertures 22, 23, 22', 23', the shaped sheet-metal part 72 has recesses 75, 76, 77, 78, with which corresponding resilient tabs or tongues 81, 82, 83, 84, provided on the contact spring 73, are associated. The contact spring 73 is adapted in its external shape to the shaped sheet-metal part 72. The shaped sheet-metal part 72 has an essentially flat bottom portion 86, from each of whose ends flat legs 87, 88 extend upward, inclined toward one another. The legs 87, 88 are bent toward one another in a common plane, and a portion 89 beginning at the leg 87 is bent one more time approximately in the middle and extends from the corresponding bending point toward the bottom portion 86. The leg 88 terminates in a free end 91 located in a plane at right angles to the bottom portion 86. An insulation-piercing slit 92 is provided in the free end 91; it connects a line by means of an insulation-piercing connection. When the insulated housing 4 is mounted, the free end 91 is located between the walls 57, 58 of the parts 2, 3.

At the transition to the leg 88, a pocketlike aperture 93 is provided on the bottom portion 86 of the shaped sheet-metal part 72; this aperture is formed by a crease 94, provided in the bottom portion 86 and beginning at the transition from the bottom portion 86 to the leg 88. The aperture 93 serves to receive the insertion tab 29 of the strip 28.

The crease 94 and the aperture 93 of the shaped sheet-metal part 72 are assigned a cut-out tongue **94*a* of the contact spring 73; this tongue extends obliquely toward the crease 94 as it leads away from the leg 88. The tongue 95 presses against the insertion tab 29 when this tab is inserted into the aperture 93 and prevents it from slipping out of the contact 5**.

An aperture 95' is also provided in the bottom portion 86; it matches an insertion aperture 96 that can be seen in FIG. 1, for instance. Contact tabs 97, 98 provided on the contact spring 73 are associated with the aperture 95', which extend sloping toward one another and serve to firmly clamp a conductor inserted through the aperture 95' into the contact 5.

Figure 6:
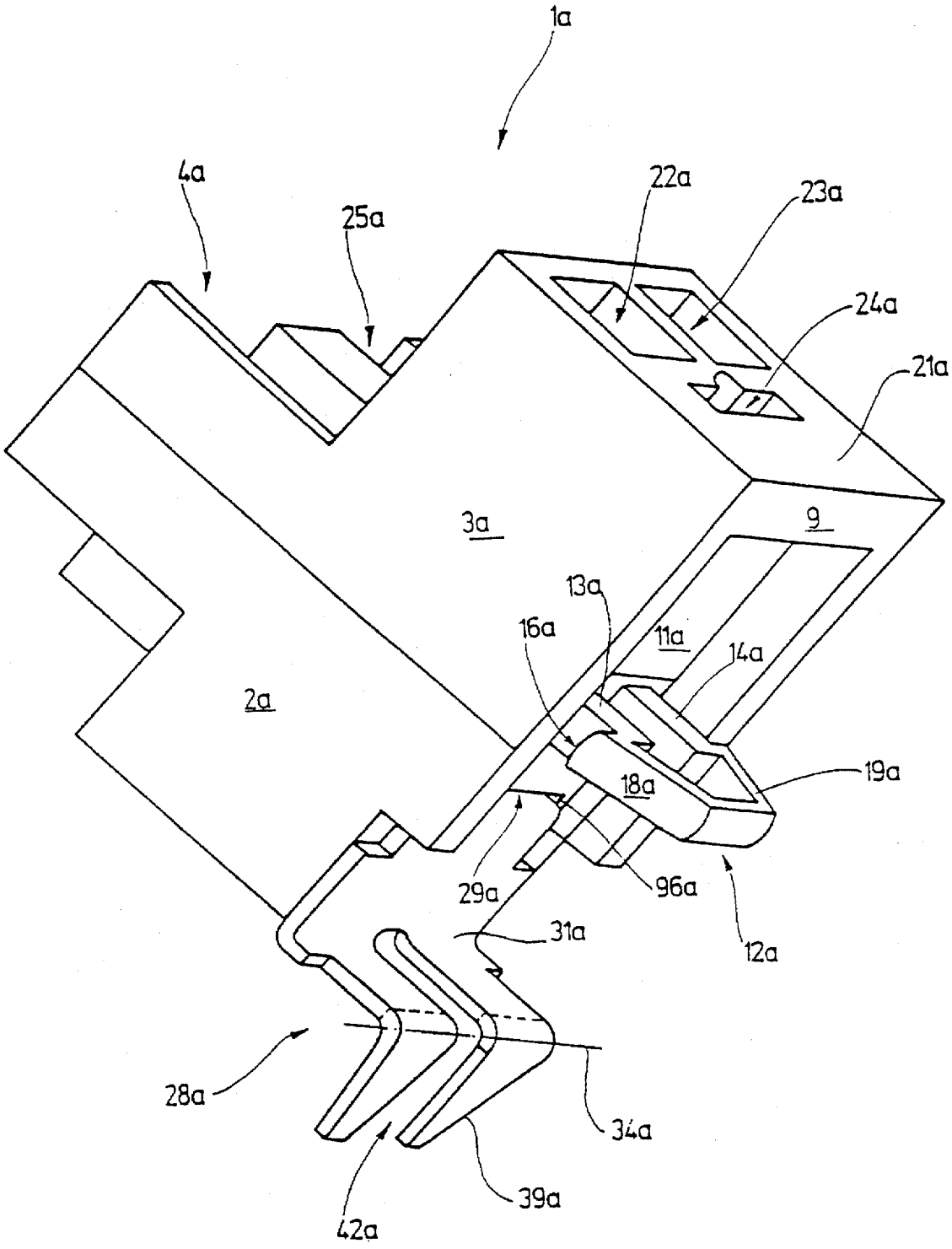
FIG. 6 is a schematic perspective view of a connection element of another embodiment.

In FIG. 6, a connection element la is shown in a modified embodiment. Where it matches the connection element 1 shown in FIG. 1, the same reference numerals are used without further description, provided with an "a" after the number for the sake of identification. The distinction from the above-described connection element 1 resides in the modified embodiment of the strip 28*a*. This strip is connected via the bottom insertion aperture 96*a* with the contact 5 disposed in the interior (FIG. 5). To that end, the strip 28*a* is bent in its neck portion 31*a*, so that part of the neck portion rests flat against the bottom 11*a* of the insulated housing 4*a*. The insertion tab 29*a* of the strip 28*a* is bent at a right angle away from the neck portion 31*a* resting on the bottom 11*a* and is retained by the contact tabs 97, 98 of the contact spring 73 that are visible in FIG. 5. The remaining description in terms of the dimensioning, use and embodiment of the insulated housing 4 applies correspondingly to the connection element 1*a*.

In a further embodiment, not shown in the drawings, the strip is not slit. This embodied is preferred above all in cases where no additional conductor is to be connected at the strip.

In other embodiments, the strip may be modified such that the transition point 37 is shifted somewhat inward into the neck portion 31 or outward toward the hook portion 36. What is essential is that it be located at a distance from the plane defined by the engagement surface 9. Moreover, it should be at a distance from the end 41 that is equal to at least half the width of the neck portion 31.

For making an electrical connection between a conductor and an electrically conductive part, and especially for connection of a protective conductor, a connection element has been provided that, to form an insulation-piercing connection with a plastic or metal support surface and/or of a line connected to other component units, has a strip which may be slit as needed. This strip is bent at an angle on its free end and firmly joined to an insulated housing, which contains contact means for connecting an electric conductor. When the connection element is mounted on a support surface, the strip is placed in hook fashion in a prefabricated aperture and inserted with a press fit into the aperture by pressure on the insulated housing, by way of lever action. Metal support surfaces become contacted thereby. Nonmetallic support surfaces form an abutment for the line, by way of which other parts are connected.

The strip, bent on its free end and forming a hook portion, is designed in terms of its width and rigidity such that it forms a lever, which facilitates insertion of the strip into the aperture provided in the support surface. The hook portion engaging the support surface from behind is inserted through the hole provided in the support surface and presses against the back side thereof when the strip is swiveled. As soon as the strip rests with its free end, that is, its hook portion, against the back side of the support surface, the corresponding point of contact defines the pivot axis about which the strip with the housing joined to it is to be pivoted on the support surface. The spacing between the neck portion and the hook portion is relatively slight, while the lever overall is relatively long. The lever is formed by the strip and is lengthened further by the housing that holds it. The lever ratios thus produce a major amplification of force. This means that the connection element can be placed without a tool or other aids on the support surface in such a way that the strip is seated with its neck portion in the intended position in the aperture. Once the hook portion has hooked into the aperture and the housing has been swiveled against the support surface, the neck portion moves easily into the aperture, even if the neck portion is markedly oversized by comparison. Reliable electric contact-making with the support surface, which for instance is in the form of a metal sheet, is thus assured. Layers of paint or oxide are readily penetrated. No additional attachment means, such as screws, rivets or the like, or additional operations are required for contacting the support surface.

The strip can be economically made as a stamped and bent part; the neck portion and the hook portion may each individually be essentially straight portions of a sheet-metal strip. These portions are bent for angle of preferably at least 90°. As a result, an angle which is at most 90° forms between the neck portion and the hook portion. This preferably acute angle has the effect that the strip rests by its free end or in other words its hook portion on the back side of the support surface before the housing rests with its engagement surface on the support surface. This assures that the neck portion will be drawn by lever action into the aperture, and that the hook portion will rest with its tip on the support surface once the connection element is installed.

By means of the strip, the support surface itself is electrically connected; the neck portion is pressed into the aperture and is held there with a press fit. This can be accomplished by forming the neck portion with a cross section whose outline cuts into the edge of the aperture. In that case, the neck portion has edges that cut into the wall of the aperture. Secure electrical contact-making is thus achieved.

If the hook portion is at a relatively acute angle to the neck portion, then the strip on insertion into the aperture can bend somewhat as needed, enabling an adaptation to support surfaces of different wall thicknesses. If bending of the strip on insertion into the aperture is to be avoided, however, and if the strip is intended to rest with its hook portion as flat as possible against the support means, then the hook portion is located with its free end at a distance from a plane defined by the engagement surface of the housing. This distance is at most as great as the wall thickness of the support surface on which the connection element is to be mounted.

The hook portion can easily be introduced into the aperture if the width of the neck portion is greater than the width of the hook portion. The length of the hook portion should exceed half the width of the neck portion. In that case, the strip can be inserted with lever action into circular holes, which means that no apertures with special shapes are needed.

A versatile design is obtained if the strip is forked, so that the hook portion and neck portion have one continuous slit, open on one edge, which is suitable for forming an SBIP connection with a line. The slit is preferably narrower in the region of the neck portion than in the region of the hook portion. This makes it possible, in addition to and independently of the support surface, to connect a conductor that is connected to further elements. These may for instance be parts provided on the electrical device or component units that are to be mounted independently in insulated fashion yet must also be grounded. It is thus also possible for an electrically nonconductive support surface to be provided for the connection element, and for the desired contacting to be effected with a conductor inserted into the slit. The insulation-piercing connection between the conductor and the strip occurs on insertion of the strip into the aperture of the support part, by means of the lever action of the strip braced by its hook portion on the support part. This can be done without the aid of tools and involves only slight forces and can therefore be done manually. It is not important whether the line is stripped of insulation before insertion or not. A continuous line that leads to a further connection on both sides can also be connected. If needed, it is also possible for multiple lines to be connected.

An especially strong seat of the strip in the aperture, which is secured against later loosening, is achieved if the neck portion has an engagement shoulder located essentially in the plane defined by the engagement surface. While on one side the strip rests on the support surface with its engagement shoulders, it rests there on its other side with the hook portion.

An attachment means that makes it possible to move the housing toward the support surface in a swiveling motion is a detent body, disposed on the engagement surface of the housing, for example. This detent body, as long as it is not yet interlocked with corresponding apertures provided in the support surface, enables the swiveling motion required for inserting the strip into the aperture and does not require any additional housing motion of any kind for attaching the housing to the support surface. In principle, any other connecting devices, such as screws, clamping brackets or the like, are also possible as the attachment means.

The housing is preferably formed by two housing parts positively joined together. The positive connection may be a snap-in or detent connection, which makes for especially simple assembly processes. However, other types of connection are also possible.

The connection element may be used advantageously for connecting different parts that are at different potentials, if the housing has at least one connecting means for connection with other similar housings. The connecting means preferably forms a positive engagement. A connection element can then be put together from individual housings that can be used for connecting protective conductors, phase lines, neutral lines, and as needed other lines to the applicable electrical device. The connecting means are by way of example grooves formed onto the housings and corresponding ribs, insertable into the grooves, which are preferably provided with detent means. The housings can thus be joined together in a simple way, by introducing the ribs into the corresponding grooves and pushing them as far as their detent position.

An especially easily manipulated way to connect the strip and the contact means located in the housing is obtained if the contact means has a springy clamping terminal, which is formed in such a way that it retains and electrically contacts a connection shaft, provided on the contact body, when the contact body is inserted by its connection shaft into the housing. This springy clamping terminal can be made by simply cutting suitable contact tabs out of the contact means. For instance, two opposed contact tabs can between them firmly clamp the shaft of the strip inserted between their free ends.

Various changes and modifications may be made, and any features described herein in connection with any one embodiment may be used with any of the others, within the scope of the inventive concept.

I claim:

1. Electrical connection element (1) to provide an electrical connection between an electrically conductive element (28) and an electrically conductive plate-like support (7) formed with at least one aperture (45) therein, especially to provide a connection for a protective, optionally grounding conductor, said connection element comprising a housing (4) of insulating material formed with an essentially flat engagement surface (9), adapted to be placed against the plate-like support (7);

at least one attachment means (12) carried by said housing and for attaching said housing to said support (7);

at least one contact element (5) located within said housing (4) for connection to at least one electrical line; and a metallic strip (28) electrically connected to said contact element (5) within the housing (5), said metallic strip (28) being formed with a bend or crease line (34) separating said strip into a neck portion (31) extending from said housing (4) and a hook portion (36) angled off from said neck portion (31) at an angle with respect to said neck portion in a direction essentially parallel to, or acutely angled with respect to said essentially flat engagement surface (9), wherein said neck portion (31) and said hook portion (36) of said metallic strip (28), together with said insulated housing (4), form a lever (48) in which the hook portion, upon insertion thereof through said aperture (45), passes beneath, becomes located under the plate-like, conductive support (7), engages thereagainst at least with an end of the hook portion and is supported by said plate-like support (7), to permit at least part of the neck portion (31) to be passed, by lever action, through said aperture (45).

2. The connection element of claim 1, characterized in that said neck portion (31) is located essentially perpendicular to a plane defined by said engagement surface (9) of said insulated housing (4) and extends outwardly along the plane;

in that said hook portion (36) is is formed pointing away from said insulated housing (4); and in that said bend or crease line (34) is located spaced from the flat engagement surface (9) of said insulated housing (4).

3. The connection element of claim 1, characterized in that said neck portion (31) and said hook portion (36) are each individually essentially straight portions of the metallic strip (28).

4. The connection element of claim 1, characterized in that said neck portion (31) has a cross section whose outline cuts into the edge of said aperture (45) provided in the plate-like region of said support (7).

5. The connection element of claim 2, characterized in that said hook portion (36) is located with its free end (41) at a distance, from a plane defined by said engagement surface (9) of said insulated housing (4), that is at most as great as the wall thickness of said support (7) on which said connection element (1) is to be located.

6. The connection element of claim 1, characterized in that the width of said neck portion (31) is greater than the width of said hook portion (36).

7. The connection element of claim 1, characterized in that said hook portion (36) has a length that is greater than half the width of said neck portion (31).

8. The connection element of claim 1, characterized in that said strip (28) is forked, so that said hook portion (36) has a slit (42) pointing away from its free end (41), said slit extending at least as far as and into said neck portion (31) and which forms a slit blade connection for insertion and retention of said conductor.

9. The connection element of claim 1, characterized in that said neck portion (31) of said strip (28) has at least one shoulder (32, 33), which is located in the plane defined by said engagement surface (9).

10. The connection element of claim 1, characterized in that said attachment means (12) is shaped and located on the housing (4) in such a way that it allows said insulated housing (4) to be brought, in a swiveling motion, to said plate-like region and to be attached thereto.

11. The connection element of claim 1, characterized in that said attachment means (12) has at least one projection (12), which is located at said engagement surface (9) of said insulated housing (4) and can be attached to at least one attachment aperture (46), provided on said support (7), by a pre-formed snap-in connection.

12. The connection element of claim 1, characterized in that said insulated housing (4) has two insulated housing parts (2, 3) that can be joined together by positive engagement.

13. The connection element of claim 1, characterized in that said insulated housing (4) has at least one connecting means (62, 63; 68, 70) for connection to other similar insulated housings (4).

14. The connection element of claim 13, characterized in that said connecting means (62, 63; 68, 70) for joining the insulated housings (4) to one another have grooves (64, 65) formed on said insulated housings (4) and ribs (68, 70) of an adjacent insulated housing, which ribs can be inserted into said grooves (64, 65).

15. The connection element of claim 14, characterized in that said grooves (64, 65) and ribs (68, 70) formed onto said insulated housings (4) are each provided with an interengaging projection-and-recess means (66, 69).

16. The connection element of claim 1, characterized in that said contact means (5) has a springy clamping terminal (72, 73), which is formed such that it holds and electrically contacts an insertion tab (29) provided on said strip (28) when said strip (28) is inserted by its insertion tab (29) into said insulated housing (4).

17. The connection element of claim 1, wherein said housing (4) extends in a direction perpendicular to said essentially flat engagement surface (9) by a distance which is large with respect to the distance between the end (41) of the hook portion (36) and said bend or crease line (34) of said metallic strip (28)' and wherein the region of said bend or crease line (34) forms a fulcrum for said lever action.

18. The connection element of claim 17, wherein said metallic strip (28), at least in the region of said neck portion (31) and said hook portion (36), is resistant with respect to deflection.

19. The connection element of claim 1, wherein said angle is between about 0° and 30°.

20. The connection element of claim 1, wherein said angle is about 15°.

* * * * *

UNITED STATES PATENT AND TRADEMARK OFFICE

CERTIFICATE OF CORRECTION

PATENT NO. : 5,700,159

DATED : December 23, 1997

INVENTOR(S) : ALBECK, Bernhard

It is certified that error appears in the above-identified patent and that said Letters Patent is hereby corrected as shown below:

Title page, Item [56] References Cited,

Under "U.S. PATENT DOCUMENTS" add:

| | | | |
|---|---|---|---|
| --4,895,526 | 1/90 | Henrici et al | 439/571 |
| 5,022,873 | 6/91 | Kollmann | 439/92 |
| 5,083,942 | 1/92 | Hahn | 439/571 |
| 5,334,054 | 8/94 | Conrad et al | 439/92 |
| 5,342,209 | 8/94 | Carney et al | 439/92 |
| 5,514,000 | 5/96 | Krause et al | 439/557-- |

Under "FOREIGN PATENT DOCUMENTS" add:

--590,568 8/77 Switzerland--

Signed and Sealed this

Sixteenth Day of June, 1998

*Attest:*

Bruce Lehman

BRUCE LEHMAN

*Attesting Officer*

*Commissioner of Patents and Trademarks*